US006265344B1

(12) United States Patent
Shimbo et al.

(10) Patent No.: US 6,265,344 B1
(45) Date of Patent: Jul. 24, 2001

(54) TRANSPARENT THERMOSENSITIVE RECORDING MATERIAL

(75) Inventors: Hitoshi Shimbo; Hideo Suzaki, both of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/417,498

(22) Filed: Oct. 13, 1999

(30) Foreign Application Priority Data

Oct. 16, 1998 (JP) ..... 10-309519

(51) Int. Cl.[7] ..... B41M 5/26
(52) U.S. Cl. ..... 503/205; 503/200; 503/226
(58) Field of Search ..... 503/200, 201, 503/226, 205

(56) References Cited

U.S. PATENT DOCUMENTS 5,286,703 2/1994 Wachi et al. ..... 503/221

FOREIGN PATENT DOCUMENTS 19630348 1/1997 (DE) .
0792754 9/1997 (EP) .

*Primary Examiner*—Bruce H. Hess
(74) *Attorney, Agent, or Firm*—Cooper & Dunham LLP

(57) ABSTRACT

A transparent thermosensitive recording material has a transparent support and a thermosensitive recording layer formed thereon, with a non-image area of the transparent thermosensitive recording material exhibiting an absorbance in a range from 0.5 to 1.2 when irradiated with light with a wavelength of 380 nm, and an absorbance of 0.7 or less when irradiated with light with a wavelength of 420 nm.

24 Claims, 1 Drawing Sheet

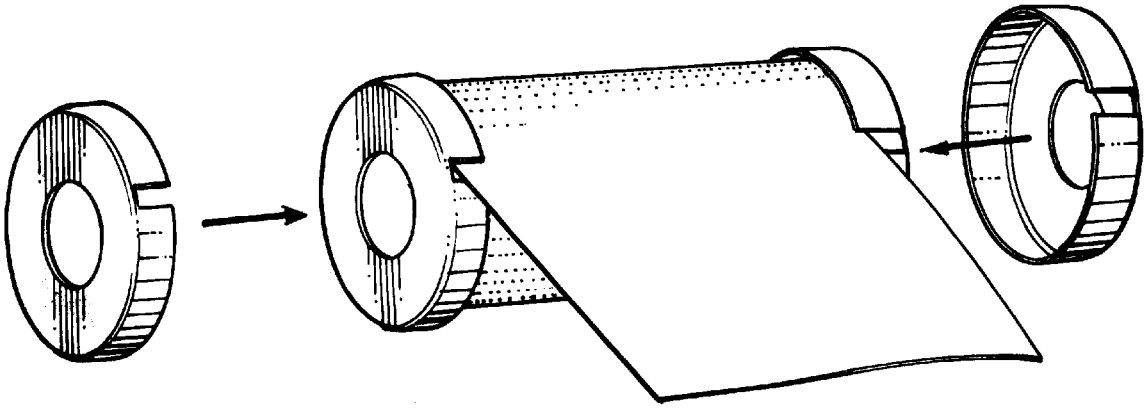

TRANSPARENT THERMOSENSITIVE RECORDING MATERIAL

BACKGROUND OF THE INVENTION

1. Field of the Invention

The present invention relates to a thermosensitive recording material which utilizes a coloring reaction, for example, between an electron-donating coloring compound and an electron-accepting compound, more particularly to a transparent thermosensitive recording material which is suitable for a film for a video printer, and especially for an image formation sheet capable of producing a high quality black image therein, that is similar to a silver salt film designed for diagnostic and consulting purposes based on magnetic resonance imaging (MRI) and computed tomography (CT) in the medical field.

2. Discussion of Background

Various kinds of recording materials which employ the process of thermosensitive coloring reaction are proposed. Such a thermosensitive recording material is generally prepared by coating a mixture of a coloring agent (such as a dye) and a color developer on the surface of paper.

In recent years, disposal of the waste liquid caused by the wet-type image formation process for a silver salt X-ray film has become a serious problem in the medical field. Further, in line with the trend toward the formation of digital image, there is an increasing demand for a dry process using a transparent film capable of easily producing an image therein.

The dry process currently employed in the medical field is divided into the following three systems: (1) light-exposing and heat-fixing system, (2) thermal transfer system, and (3) direct thermosensitive recording system.

The thermosensitive recording material, which is used in the above-mentioned thermosensitive recording system, is usable as a recording material for an electronic computer, facsimile apparatus, ticket vending apparatus, label printer, and recorder. This is because the thermosensitive recording material has the advantages that complicated processes such as development and image fixing are not required, recording can be achieved for a short period of time using a relatively simple apparatus, there is no noise development, and the manufacturing cost is low.

In such a thermosensitive recording material, colorless or light-colored leuco dyes having a lactone, lactam, or spiropyran ring are used as coloring dyes, and organic acids and phenols are conventionally employed as color developers. There is also known a thermosensitive recording material of an organic silver salt type which employs a metallic salt of organic acid such as silver behenate as the coloring agent, and a reducing agent such as acid as the color developer. In addition, there is also known a reversible thermo-sensitive recording material which comprises the combination of a leuco dye and a color developer or the combination of a matrix resin and an organic low-molecular weight compound dispersed in the matrix resin. The reversible thermosensitive recording material is capable of reversibly forming an image therein and erasing the image therefrom by reversibly changing the transparency, the density, or the color of the recording material.

When the previously mentioned conventional thermosensitive recording material which comprises a leuco dye, a color developer, and a binder resin is exposed to strong light, for example, ultraviolet light, for a long period of time, there gradually appear unfavorable phenomena such as yellowing of a background portion (non-image area) of the recording material, and decreasing of the image density of an image portion formed on the recording material unless any additive is employed. In other words, there occurs the problem that the image recognition gradually becomes difficult as the image bearing thermosensitive recording material is exposed to light. This problem is produced likewise in other thermosensitive recording systems.

To solve the above-mentioned problem, it is proposed to add an additive for promoting the light resistance of the recording material, such as an ultraviolet light absorber, which additive will be hereinafter referred to as a light resistant additive, to any layers that constitute the thermosensitive recording material. The above-mentioned light resistant additive has been conventionally studied, and there are proposed as the light resistant additives a benzotriazole ultraviolet light absorber (Japanese Laid-Open Patent Application 61-193883), a fluorescent whitening agent (Japanese Laid-Open Patent Application 62-184880), a hindered amine light stabilizer (Japanese Laid-Open Patent Application 63-137887), finely-divided particles of inorganic oxides (Japanese Laid-Open Patent Application 7-25147); and a mixture of the above-mentioned materials (Japanese Laid-Open Patent Application 8-282114). When the amount of light resistant additive is increased in the transparent thermosensitive recording material, the color change of the recording material caused by light exposure can be inhibited more effectively.

However, a transparent thermosensitive recording material has the drawback that the change in color or density of the image portion is striking when compared with the reflection type thermosensitive recording material. As is apparent from the light absorbance curve of a transparent thermosensitive recording material, the absorbance substantially increases in proportion to the rise in the density, and the absorption peak is very sharp when the light absorbance curve of a transparent thermosensitive recording material is compared with that of a conventional reflection type thermosensitive recording material. Further, with respect to the transparent thermosensitive recording material, the color development sensitivity and the color tone of a produced image may considerably vary depending upon the amount of light resistant additive added to the recording material. Therefore, the target to be attained by the transparent thermosensitive recording material becomes higher than that by the reflection type thermosensitive recording material. In other words, the control of the above-mentioned change becomes considerably difficult in the transparent thermosensitive recording material The light resistant additive shows slight absorption in the visible wave range, so that the color of the background portion (non-image area) of the conventional transparent thermosensitive recording material appears different depending on the employed light source. This tendency is called a light-source dependence in the present invention.

The light-source dependence will now be explained in detail using two kinds of light sources, that is, a diffused light as represented by d/0, and a specular light as represented by 0/0. In the above, d/0 and 0/0 are geometrical conditions of a lighting and a light receptor in measurement of the color of a non-image area of the transparent thermosensitive recording material. More specifically, "d" denotes diffused directions, and "0" denotes the angle of 0°. The geometrical condition of d/0 means that the diffused light enters a transparent recording material, and the light transmitted by the transparent recording material enters the light receptor in a vertical direction. On the other hand, the geometrical condition of 0/0 means that the specular light enters a transparent recording material, and the light transmitted by the transparent recording material enters the light receptor in a vertical direction.

When the specular light (0/0) is used as the light source, the absorbance of a transparent thermosensitive recording material detected by the light receptor is higher as a whole, in particular, in the short wavelength region, than the absorbance thereof obtained by using a diffused light (d/0) as the light source.

Even though the transparent thermosensitive recording material is entirely colored, the observers perceive the difference in color depending upon the light source. In the case where the color of the background is a complementary color of the perceived color when either of the above-mentioned light sources is employed, the light-source dependence becomes more noticeable.

In Japanese Laid-Open Patent Application 4-197778, there is proposed a transparent thermosensitive recording material which comprises a light shielding layer capable of showing a transmittance of 5% or less when irradiated with light of 370 nm, a transmittance of 70% or less when irradiated with light of 400 nm, and a transmittance of 70% or more in the entire visible light range. When the above mentioned specular light (0/0) is used as the light source, the light-source dependence of a background portion (non-image area) of the recording material becomes considerably large due to the presence of the above-mentioned light shielding layer.

The absorption in the near ultraviolet region is influenced by the haze of the transparent thermosensitive recording material. In general, when the haze of the transparent recording material is high, light diffusion takes place at many places in the layers of the recording material. Such a transparent recording material having a high haze value does not easily transmit the lights in the short wavelength region. The result is that the dependence of the color tone of the background portion of the recording material on the employed light source is increased, and the transparency is lowered, thereby making the image recognition more difficult.

The image recognition performance is further influenced by other factors, such as fogging of the background of the recording material, difference in refractive index of binder resins employed in the layers, and the particle size of a filler dispersed in the recording material. The control of the above-mentioned factors becomes important for the improvement of image recognition performance.

To reduce the light-source dependence, it is proposed to increase the amount of a dye or pigment used as the colorant when the transparent thermosensitive recording material is entirely colored. However, this method is attended by the problem such as the increase of the background density.

SUMMARY OF THE INVENTION

Accordingly, an object of the present invention is to provide a transparent thermosensitive recording material capable of showing high light resistance, and excellent image recognition performance without the dependence on the employed light source even when an extremely precise image such as a medical image is formed therein, especially by controlling the absorption in the near ultraviolet region.

The above-mentioned object of the present invention can be achieved by a transparent thermosensitive recording material comprising a transparent support and a thermosensitive recording layer formed thereon, with a non-image area of the transparent thermosensitive recording material exhibiting an absorbance in a range from 0.5 to 1.2 when irradiated with light with a wavelength of 380 nm, and an absorbance of 0.7 or less when irradiated with light with a wavelength of 420 nm.

It is preferable that the thermosensitive recording material exhibit a haze of 40% or less.

The thermosensitive recording layer may comprise a colorless or light-colored leuco dye, a color developer capable of inducing coloring formation in the leuco dye, and a binder resin.

Further, it is preferable that the above-mentioned color developer comprise an organic phosphonic acid compound.

The thermosensitive recording material may be blue-colored.

The thermosensitive recording material may further comprise a protective layer which is provided on the thermosensitive recording layer, and/or a backcoat layer which is provided on the support, opposite to the thermosensitive recording layer with respect to the support.

It is preferable that the protective layer have a coefficient of friction in a range of 0.07 to 0.14.

It is preferable that the backcoat layer comprise an ultraviolet light absorber.

Furthermore, it is preferable that the backcoat layer have a surface resistivity of $1\times10^{10}\Omega$ or less.

The thermosensitive recording layer may be a reversible thermosensitive recording layer whose transparency, density or color reversibly changes by the application of heat thereto.

When the thermosensitive recording material is prepared in the form of a sheet, it is preferable that the sheet-shaped thermosensitive recording material have a Gurley stiffness of 500 mgf to 2,500 mgf when measured in the coating direction of the thermosensitive recording layer.

In the above case, it is preferable that the support be a polyethylene terephthalate film with a thickness of 150 to 230 $\mu$m.

When the sheet-shaped thermosensitive recording material is slit and rolled in the form of a roll, it is preferable that the roll of the thermosensitive recording material have a Gurley stiffness of 190 mgf to 250 mgf when measured in the rolling direction of the thermosensitive recording material.

In such a case, it is preferable that the support be a polyethylene terephthalate film with a thickness of 90 to 110 $\mu$m.

It is preferable that the above-mentioned roll of the thermosensitive recording material have an inner diameter of 35 mm or more.

Further, it is preferable that the roll comprise at least one stopper which is attached to each of both ends of the roll.

In addition, the thermosensitive recording material in the form of a roll may bear a mark thereon indicating an end position of the roll.

The thermosensitive recording material in the form of a sheet or a roll may be hermetically sealed in a bag with light shielding properties and/or moisture-proof properties.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein:

A single FIGURE is a schematic view which shows a transparent thermosensitive recording material in the form of a roll, provided with stoppers.

DESCRIPTION OF THE PREFERRED EMBODIMENTS

A non-image area, that is, a background portion of the transparent thermosensitive recording material according to the present invention shows an absorbance in the range of 0.5 to 1.2 when irradiated with light with a wavelength of 380 nm, and an absorbance of 0.7 or less when irradiated with light with a wavelength of 420 nm. The above-mentioned measurement is carried out using the specular light (0/0) as the light source.

When the former absorbance exceeds the above specified range, the light-source dependence of the transparent thermosensitive recording material is noticeable. In contrast to this, when the absorbance is lower than the above specified range, the thermosensitive recording material easily causes the change in color by light exposure. In addition, even though the absorbance with respect to the light of a wavelength of 380 nm is within the above-mentioned range, there appears the tendency of light-source dependence when the absorbance with respect to the light to a wavelength of 420 nm is more than 0.7. It is considered that the smaller the absorbance with respect to the light having a wavelength of 420 nm, the better the result is. However, when the absorbance with respect to the light with a wavelength of 420 nm is extremely small, the glossiness is increased and the glare protection is decreased. Therefore, it is preferable that the absorbance with respect to the light having a wavelength of 420 nm be in the range of 0.2 to 0.7. When those two absorbance values are within the above-specified respective ranges, there is no tendency of light-source dependence of the background portion, and the light resistance of the recording material is excellent.

To obtain the above-mentioned absorbance values, it is preferable to employ light resistant additives, such as benzotriazole compounds, benzophenone compounds, hindered amine light stabilizers, finely-divided particles of inorganic metallic oxides, hindered phenolic antioxidant, and fluorescent whitening agent. Of these light resistant additives, a benzotriazole compound is particularly preferable because this compound can reduce the deterioration by light. However, in order to obtain the predetermined absorbance values and desired light resistance of the recording material, the above-mentioned benzotriazole compound may be used in combination with the hindered phenolic antioxidant which exhibits no absorption in the visible light range. This is because the benzotriazole compound exhibits its absorption in the short wavelength region of the visible light range.

When the light resistant additive is used in the present invention, the kind of light resistant additive is not particularly limited. The method of introducing the light resistant additive into the thermosensitive recording material is not particularly limited either. For example, the light resistant additive may be used in the form of a solution, a dispersion, or microcapsules. In the case where the employed light resistant additive has light shielding properties, it is preferable that the light resistant additive be contained in the backcoat layer because the light is commonly directed to the back side of the thermosensitive recording material, opposite to the thermosensitive recording layer side, when the printed image is observed. In addition, the preservation stability of the printed image can be maintained when such a light resistant additive is contained in the backcoat layer.

Generally, the change in the absorbance obtained from the absorption spectrum within the near ultraviolet light region appears more striking when the specular light (0/0) is employed as compared with the case where the diffused light (d/0) is employed. An image formed on a transparent thermosensitive recording film for medical purposes, for example, by computed tomography (CT), is mostly observed in such a manner that the recording film is put on a film viewer with lighting (called "Schaukasten") . In this case, the diffused light is employed as a light source. However, since there is a possibility that the image-bearing film will be held to the sunlight for observation, it is desirable that the color of the transparent thermosensitive recording film look identical regardless of the light source.

The above-mentioned light resistant additives exhibit their absorption maxima in the ultraviolet region (wave range lower than 400 nm). The train of the absorption peak extends into the visible light range, toward the wavelength of about 420 nm depending on the amount of light resistant additive. By the way, humans cannot perceive the light with a wavelength of 380 nm or less as stated in the Japanese Industrial Standards (JIS Z8701). The background portion (non-image area) of the transparent thermosensitive recording material shows remarkably low absorbance within the visible light range, so that the color rendering of the background portion is largely influenced by the light absorption in the range of 380 to 420 nm. Therefore, the absorbance in the range of 380 to 420 nm is considered to be of great importance.

The lower the haze of the transparent thermo-sensitive recording material, the more preferable. This is because the previously mentioned light resistant additives can be added in large amounts. In particular, the image recognition performance can be remarkably improved when the haze of the transparent recording material is 40% or less. It is possible to decrease the haze value of the transparent thermosensitive recording material by reducing the particle size of components dispersed in the recording layer and protective layer, such as a color developer and a filler, and choosing a binder resin with an appropriate refractive index. To lower the haze of the recording material is advantageous from the viewpoint of prevention of deterioration by light because the amount of light resistant additive such as a benzotriazole compound can be increased. However, when the haze is extremely lowered, glare protection of the transparent recording material is lowered. As a result, the medical image put on the film viewer cannot be exactly observed. Therefore, it is preferable that the haze of the transparent thermosensitive recording material of the present invention be in the range of 10 to 40%.

In the thermosensitive recording material of the present invention, it is preferable that the thermosensitive recording layer comprise a colorless or light-colored leuco dye, a color developer capable of inducing coloring formation in the leuco dye, and a binder resin serving as a binder agent. In particular, it is more preferable to use a leuco dye soluble in an organic solvent in combination with a color developer which is insoluble or slightly soluble in the organic solvent and can be dispersed therein in the form of particles with an average particle size of 1.0 $\mu$m or less, preferably 0.5 $\mu$m or less. In this case, there can be obtained a transparent thermosensitive recording material with minimum fogging of background, and high transparency.

Further, it is preferable that the color developer comprise an organic phosphonic acid compound when the prevention of fogging, and the improvement of dispersion properties, and the fastness of the obtained image are taken into consideration.

In order to both control the light-source dependence and improve the light resistance, for instance, proper combination of the light resistant additives may be selected, the particle size of the components dispersed in each layer, such as a color developer and a filler may be decreased, and an appropriate transparent support and a proper binder resin may be chosen.

The transparent thermosensitive recording material of the present invention may be blue-colored for the purpose of obtaining glare protection effect, and improving the image recognition performance. In this case, the transparent support itself may be blue-colored, or at least one layer formed by coating may be subjected to bluing.

In the bluing process, it is preferable that the transmission density of the transparent thermosensitive recording material be in the range of 0.15 to 0.25. Further, when the color of the transparent thermosensitive recording material is represented by the CIE L*a*b* color space, it is preferable that the color be determined in such a way that one of the chromaticness indices a* is in the range of −4 to −12, and another chromaticness index b* is in the range of −5 to −15. In the above perceived color space, when the chromaticness index a* is a negative number, the greater the absolute value, the more greenish the color appears; and when the index a* is a positive number, the greater the absolute value, the more reddish the color appears. Concerning the chromaticness index b*, when it is a negative number, the greater the absolute value, the more bluish the color appears, and when it is a positive number, the greater the absolute value, the more yellowish the color appears.

The above perceived color space is measured using the standard illuminant $D_{65}$ of diffuse/specular (d/0) light under the conditions that the standard observer is set at 10° and the physical resolution is set at 10 nm.

When the bluing degree of the transparent thermosensitive recording material is excessive, the image recognition performance is lowered due to the decrease in image contrast.

The transparent tnermosensitive recording material of the present invention may comprise a reversible thermosensitive recording material whose transparency or density is reversibly changeable depending upon the temperature thereof. Reversible change in transparency can be achieved by employing a reversible thermosensitive recording material comprising a matrix resin and an organic low-molecular weight compound dispersed in the matrix resin. In such a reversible thermosensitive recording material, the background portion, that is, a non-image area referred in the present invention means a transparent portion. On the other hand, when a recording material comprising a leuco dye and a color developer having a long-chain alkyl group is employed, the image density can be reversibly changed. In this case, the background portion means a non-color-developed portion.

While in practice, the transparent thermosensitive recording material in the form of a sheet may be slit into strips, each strip being rolled in the form of a roll. The recording material in the form of a roll is remarkably advantageous because the recording apparatus can be made compact. In this case, however, when a transparent plastic film is used as the support, the roll tends to become unwound before image recording because the stiffness of the plastic film is stronger than that of a sheet of paper. Further, as compared with a roll of paper, the roll length cannot be increased. In addition, the handling characteristics of the recording material are unsatisfactory after image recording because the recording material tends to become curled.

To eliminate the above-mentioned drawbacks, when a sheet-shaped thermosensitive recording material is rolled while in use, it is preferable that a roll of the transparent thermosensitive recording material have a Gurley stiffness of 190 to 250 mgf in the rolling direction thereof. The Gurley stiffness is defined in JAPAN TAPPI No 40. When the recording material is provided with the above specified stiffness, the roll of recording material can be prevented from becoming unwound before image recording, and prevented from becoming curled after image recording. Since proper stiffness can be maintained after image recording, the recording film cut from the roll can be favorably set on the film viewer. In particular, a portion adjacent to the center of the roll can be effectively prevented from becoming unwound before image recording, and becoming curled after image recording.

When the Gurley stiffness is less than 190 mgf, the stiffness of the recording material is insufficient although the roll of recording material can be prevented from becoming unwound before image recording and the recording film can be prevented from becoming curled after image recording. Therefore the attachment of the recording film to a film viewer becomes more troublesome as compared with the case where a silver salt film is employed. On the other hand, when the Gurley stiffness exceeds 250 mgf, the roll tends to easily become unwound before image recording, and the recording film tends to easily become curled after image recording. Namely, the handling characteristics are considerably poor not only in the state of a roll before image recording, but also in the form of a film after image recording.

When a sheet-shaped transparent thermosensitive recording material is prepared for a practical use, it is preferable that the sheet-shaped thermosensitive recording material be adjusted to have a Gurley stiffness of 500 to 2,500 mgf, more preferably 800 to 1,500 mgf, in the coating direction of the thermosensitive recording layer. When the Gurley stiffness is 500 mgf or more, the thermosensitive recording sheets can be precisely picked up from the sheet cassette one by one in the recording apparatus. When the Gurley stiffness is 2,500 mgf or less, the recording sheet can be smoothly transported in the recording apparatus because the flexibility of the recording sheet is proper.

The stiffness of each layer formed by coating can be controlled by appropriately selecting a binder resin in light of the physical properties of the binder resin, such as the glass transition temperature and the softening point, and appropriately selecting a filler in light of the physical properties of the filler, such as the hardness, the particle size, and the particle shape, and controlling the thickness of each layer.

In any case, the thermosensitive recording material of the present invention may be hermetically sealed in a bag with light shielding properties and/or moisture-proof properties.

Examples of the materials with moisture-proof properties are polyethylene, polypropylene, vinyl chloride, polyethylene-polyvinyl alcohol copolymer, and polyester. An aluminum-deposited vinyl bag and a black-colored vinyl bag may be used as the bag with light shielding properties. Those materials may be used in combination when necessary, for example, by laminating. The opening of the bag may be hermetically heat-sealed or sealed with an adhesive tape or clip.

The materials for use in the transparent thermosensitive recording material of the present invention will now be explained in detail.

Examples of the materials for the transparent support are cellulose derivatives such as cellulose triacetate, polyolefin such as polypropylene and polyethylene, and polystyrene. Such a resin film may be laminated. It is preferable to employ a film made of a polyester resin such as polyethylene terephthalate, polybutylene terephthalate, or polyethylene naphthalate.

To improve the adhesion between the support and the layer to be formed thereon by coating, at least one surface of the transparent support may be subjected to corona discharge treatment, oxidation reaction treatment using, for example, chromic acid, and etching treatment.

It is preferable that the haze of the transparent support itself be 10% or less to obtain a thermosensitive recording material with high transparency.

In the present invention, a polyethylene terephthalate film is most preferable as the transparent support from the viewpoints of manufacturing cost, and heat resistance and other properties of the support.

Control of the thickness of the transparent support is important to obtain the previously mentioned stiffness of the recording material. When the transparent thermosensitive recording sheet is rolled while in use, it is preferable that the thickness of the transparent support be in the range of 90 to 110 $\mu$m in light of the roll length. on the other hand, when the thermosensitive recording material is prepared in the form of a sheet for practical use, the transparent support may be controlled to have a thickness of 150 to 230 $\mu$m when the transporting performance of the recording material is taken into consideration.

The thermosensitive recording layer comprises a leuco dye, a color developer and a binder resin.

A variety of conventional binder resins are usable for the thermosensitive recording layer. Specific examples of the binder resins are polyethylene, polyvinyl acetate, polyacrylamide, maleic acid copolymer, polyacrylic acid and esters thereof, polymethacrylic acid and esters thereof, vinyl chloride-vinyl acetate copolymer, styrene copolymer, polyester, polyurethane, polyvinyl butyral, ethyl cellulose, polyvinyl acetal, polyvinyl acetoacetal, polycarbonate, epoxy resin, polyamide, polyvinyl alcohol, starch, and gelatin. These resins may be employed alone or in combination.

The leuco dye for use in the present invention is an electron donating compound, and a colorless or light-colored dye precursor. For example, conventional leuco compounds, such as triphenylmethane phthalide leuco compounds, triallylmethane leuco compounds, fluoran leuco compounds, phenothiazine leuco compounds, thiofluoran leuco compounds, xanthene leuco compounds, indophthalyl leuco compounds, spiropyran leuco compounds, azaphthalide leuco compounds, couromeno-pyrazole leuco compounds, methine leuco compounds, rhodamineanilinolactam leuco compounds, rhodaminelactam leuco compounds, quinazoline leuco compounds, diazaxanthene leuco compounds, and bislactone leuco compounds are preferably employed.

Those leuco dyes may be used alone or in combination.

Specific examples of the leuco compounds for use in the present invention are as follows:

2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-ethylamino)fluoran,
2-anilino-3-methyl-6-(N-n-amyl-N-ethylamino)fluoran,
2-anilino-3-methyl-6-(N-amyl-N-ethylamino)fluoran,
2-anilino-3-methyl-6-(N-isoamyl-N-ethylamino)fluoran,
2-anilino-3-methyl-6-(N-n-propyl-N-isopropylamino)fluoran,
2-anilino-3-methyl-6-(N-cyclohexyl-N-methylamino)fluoran,
2-anilino-3-methyl-6-(N-ethyl-p-toluidino)fluoran, and
2-anilino-3-methyl-6-(N-methyl-p-toluidino)fluoran.

The color developer for use in the thermosensitive recording layer is an electron-accepting compound capable of inducing color formation in the above-mentioned leuco dyes. A variety of conventional electron-accepting color developers can be employed in the present invention. In particular, an electron-accepting color developer having a long-chain alkyl group in its molecule as stated in Japanese Laid-Open Patent Application 5-124360 is preferably used as the color developer in the present invention. For instance, there can be employed:

(a) an organic phosphonic acid compound having an aliphatic group with 12 or more carbon atoms, and an acid phosphonate having an aliphatic group with 16 or more carbon atoms,
(b) an aliphatic carboxylic acid compound having an aliphatic group with 12 or more carbon atoms,
(c) a phenol compound, and
(d) a metallic salt of mercaptoacetic acid having an altphatic group with 10 to 18 carbon atoms.

The above-mentioned aliphatic group includes a straight-chain or branched alkyl group or alkenyl group, which may have a substituent such as a halogen atom, an alkoxyl group, or an ester group.

The previously mentioned color developers will now be explained in detail.

(a) Organic Phosphonic Acid Compound and Acid Phosphonate

An organic phosphonic acid compound represented by the following formula (1) is preferably employed.

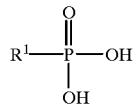

(1)

wherein $R^1$ is a straight-chain alkyl group having 12 to 24 carbon atoms.

Specific examples of the organic phosphonic acid compounds represented by formula (1) are as follows: dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, and octacosylphosphonic acid.

As the organic phosphonic acid compound, an $\alpha$-hydroxyalkyl phosphonic acid represented by the following formula (2) is also preferably employed.

(2)

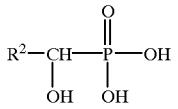

wherein $R^2$ is an aliphatic group having 11 to 29 carbon atoms.

Specific examples of the α-hydroxyalkyl phosphonic acids represented by formula (2) are as follows: α-hydroxydodecyl phosphonic acid, α-hydroxytetradecyl phosphonic acid, α-hydroxyhexadecyl phosphonic acid, α-hydroxyoctadecyl phosphonic acid, α-hydroxyeicosyl phosphonic acid, α-hydroxydocosyl phosphonic acid, and α-hydroxytetracosyl phosphonic acid.

Furthermore, an acid organic phosphonate represented by the following formula (3) is also preferably employed.

(3)

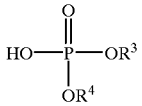

wherein $R^3$ is an aliphatic group having 16 or more carbon atoms, and $R^4$ is a hydrogen atom or an aliphatic group having one or more carbon atoms.

Specific examples of the acid organic phosphonate represented by formula (3) are as follows: dihexadecyl phosphonate, dioctadecyl phosphonate, dieicosyl phosphonate, didocosyl phosphonate, monohexadecyl phosphonate, monooctadecyl phosphonate, monoeicosyl phosphonate, monodocosyl phosphonate, methylhexadecyl phosphonate, methyloctadecyl phosphonate, methyleicosyl phosphonate, methyldocosyl phosphonate, amylhexadecyl phosphonate, octylhexadecyl phosphonate, and laurylhexadecyl phosphonate.

(b) Aliphatic carboxylic acid compound

An α-hydroxy aliphatic acid compound represented by the following formula (4) is preferably employed.

$$R^5—CH(OH)—COOH \quad (4)$$

wherein $R^5$ is an aliphatic group having 12 or more carbon atoms.

Specific examples of the α-hydroxy aliphatic carboxylic acid compounds are as follows; α-hydroxydecanoic acid, α-hydroxytetradecanoic acid, α-hydroxyhexadecanoic acid, α-hydroxyoctadecanoic acid, α-hydroxypentadecanoic acid, α-hydroxyeicosanoic acid, α-hydroxydocosanoic acid, α-hydroxytetracosanoic acid, α-hydroxyhexacosanoic acid, and a-hydroxyoctacosanoic acid.

Furthermore, there is also preferably employed an aliphatic carboxylic acid compound having a halogen-substituted aliphatic group having 12 or more carbon atoms, with the halogen atom bonded to at least one carbon atom at α-position or β-position of the compound.

Specific examples of such halogen-substituted compounds are as follows: 2-bromohexadecanoic acid, 2-bromoheptadecanoic acid, 2-bromooctadecanoic acid, 2-bromoeicosanoic acid, 2-bromodocosanoic acid; 2-bromotetracosanoic acid, 3-bromooctadecanoic acid, 3-bromoeicosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocosanoic acid, 2-iodohexadecanoic acid, 2-iodooctadecanoic acid, 3-iodohexadecanoic acid, 3-iodooctadecanoic acid, and perfluorooctadecanoic acid.

As the aliphatic carboxylic acid compound used as the color developer, there can be preferably employed an aliphatic carboxylic acid compound having an aliphatic group having 12 or more carbon atoms, with an oxo group being replaced by at least one carbon atom at the α-position, β-position or γ-position.

Specific examples of such compounds are as follows: 2-oxododecanoic acid, 2-oxotetradecanoic acid, 2-oxohexadecanoic acid, 2-oxooctadecanoic acid, 2-oxoeicosanoic acid, 2-oxotetracosanoic acid, 3-oxododecanoic acid, 3-oxotetradecanoic acid, 3-oxohexadecanoic acid, 3-oxooctadecanoic acid, 3-oxoeicosanoic acid, 3-oxotetracosanoic acid, 4-oxohexadecanoic acid, 4-oxooctadecanoic acid, and 4-oxodocosanoic acid.

As the aliphatic carboxylic acid compound, a dibasic acid compound represented by the following formula (5) is preferably employed.

(5)

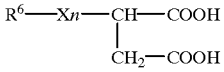

wherein $R^6$ is an aliphatic group having 12 or more carbon atoms, X is an oxygen atom or a sulfur atom, and n is an integer of 1 or 2.

Specific examples of the dibasic acid compounds represented by formula (5) are as follows: dodecylmalic acid, tetradecylmalic acid, hexadecylmalic acid, octadecylmalic acid, eicosylmalic acid, docosylmalic acid, tetracosylmalic acid, dodecylthiomalic acid, tetradecylthiomalic acid, hexadecylthiomalic acid, octadecylthiomalic acid, eicosylthiomalic acid, docosylthiomalic acid, tetracosylthiomalic acid, dodecyldithiomalic acid, tetradecyldithiomalic acid, eicosyldithiomalic acid, docosyldithiomalic acid, and tetracosyldithiomalic acid.

The following dibasic acid compounds represented by formula (6) are preferably employed:

(6)

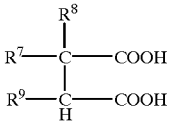

wherein $R^7$, $R^8$ and $R^9$ are each a hydrogen atom or an aliphatic group, provided that at least one of $R^7$, $R^8$ and $R^9$ is an aliphatic group having 12 or more carbon atoms.

Specific examples of the dibasic acid compounds represented by formula (6) are as follows: dodecylbutanedioic acid, tridecylbutanedioic acid, tetradecylbutanedioic acid, pentadecylbutanedioic acid, octadecylbutanedioic acid, eicosylbutanedioic acid, docosylbutanedioic acid, 2,3-dihexadecylbutanedioic acid, 2,3-dioctadecylbutanedioic acid, 2-methyl-3-dodecylbutanedioic acid, 2-methyl-3-tetradecylbutanedioic acid, 2-methyl-3-hexadecylbutanedioic acid, 2-ethyl-3-dodecylbutanedioic acid, 2-propyl-3-dodecylbutanedioic acid, 2-octyl-3-hexadecylbutanedioic acid, and 2-tetradecyl-3-octadecylbutanedioic acid.

Further, the following dibasic acid compounds represented by formula (7) are also preferably employed:

(7)

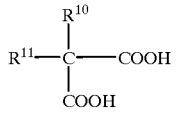

wherein $R^{10}$ and $R^{11}$ are each a hydrogen atom or an aliphatic group, provided that at least one of $R^{10}$ and $R^{11}$ is an aliphatic group having 12 or more carbon atoms.

Specific examples of the dibasic acid compounds represented by formula (7) are as follows: dodecylmalonic acid, tetradecylmalonic acid, hexadecylmalonic acid, octadecylmalonic acid, eicosylmalonic acid, docosylmalonic acid, tetracosylmalonic acid, didodecylmalonic acid, ditetradecylmalonic acid, dihexadecylmalonic acid, dioctadecylmalonic acid, dieicosylmalonic acid, didocosylmalonic acid, methyloctadecylmalonic acid, methyldocosylmalonic acid, methyltetracosylmalonic acid, ethyloctadecylmalonic acid, ethyleicosylmalonic acid, ethyldocosylmalonic acid, and ethyltetracosylmalonic acid.

Furthermore, the following dibasic acid compounds represented by formula (8) can also be preferably employed:

(8)

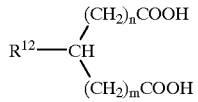

wherein $R^{12}$ is an aliphatic group having 12 or more carbon atoms; and n is an integer of 0 or 1, m is an integer of 1, 2 or 3, and when n is 0, m is 2 or 3, while when n is 1, m is 1 or 2.

Specific examples of the dibasic acid compounds represented by formula (8) are as follows: 2-dodecyl-pentanedioic acid, 2-hexadecyl-pentanedioic acid, 2-octadecyl-pentanedioic acid, 2-eicosyl-pentanedioic acid, 2-docosyl-pentanedioic acid, 2-dodecyl-hexanedioic acid, 2-pentadecyl-hexanedioic acid, 2-octadecyl-hexanedioic acid, 2-eicosyl-hexanedioic acid, and 2-docosyl-hexanedioic acid.

In the present invention, tribasic acid compounds such as a citric acid acylated with a long-chain aliphatic acid can also be employed as the aliphatic carboxylic acid compounds. To be more specific, tribasic acid compounds represented by the following formulae (9), (10) and (11) are usable:

(9)

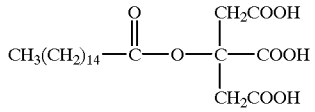

(10)

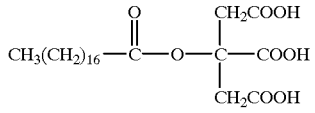

-continued (11)

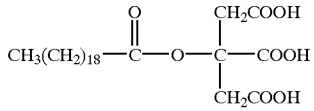

(c) Phenol Compound

Phenol compounds can be preferably employed as the color developers for use in the present invention.

Specific examples of the phenol compounds are as follows: 4,4'-isopropylidenediphenol, 1,1-bis(4-hydroxyphenyl)cyclohexane, 2,2-bis(4-hydroxyphenyl)-4-methylpentane, benzyl 4-hydroxybenzoate, 4,4'-dihydroxydiphenylsulfone, 2,4'-dihydroxydiphenylsulfone, 4-hydroxy-4'-isopropoxydiphenylsultone, bis(3-allyl-4-hydroxyphenyl)sulfone, 4-hydroxy-4'-methyldiphenylsulfone, 4-hydroxyphenyl-4'-benzyloxyphenylsulfone, 1,1-bis(4-hydroxyphenyl)-1-phenylethane, 1,4-bis[α-methyl-α-(4'-hydroxyphenyl)ethyl]benzene, 1,3-bis[α-methyl-α-(4'-hydroxyphenyl)ethyl]benzene, di(4-hydroxy-3-methylphenyl)sulfide, and 2,2'-thiobis(3-tertoctylphenol).

Furthermore, the following phenol compounds represented by formula (12) are preferably employed:

(12)

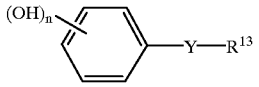

wherein Y is —S—, —O—, —CONH—, or —COO—; $R^{13}$ is an aliphatic group having 12 or more carbon atoms; and n is an integer of 1 to 3.

Specific examples of the phenol compounds represented by formula (12) are as follows: p-(dodecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecycarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate, octadecyl gallate, eicosyl gallate, docosyl gallate, and tetracosyl gallate.

As the phenol compounds, there can also be employed an alkyl ester of caffeic acid represented by the following formula (13).

(13)

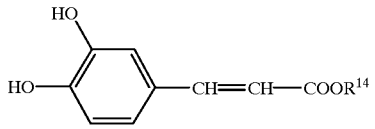

wherein $R^{14}$ is an alkyl group having 5 to 8 carbon atoms.

Specific examples of the alkyl ester of caffeic acid represented by formula (13) are as follows: n-pentyl caffeate, n-hexyl caffeate, and n-octyl caffeate. (d) Metallic salt of mercaptoacetic acid A metallic salt of alkylmercaptoacetic acid or alkenylmercaptoacetic acid represented by the following formula (14) can be preferably employed as the color developer.

$$(R^{15}—S—CH_2—COO)_2M \quad (14)$$

wherein $R^{15}$ is an aliphatic group having 10 to 18 carbon atoms; and M is a metal selected from the group consisting of tin, magnesium, zinc, and copper.

Specific examples of the metallic salt of mercaptoacetic acid represented by formula (14) are as follows: tin decylmercaptoacetate, tin dodecylmercaptoacetate, tin tetradecylmercaptoacetate, tin hexadecylmercaptoacetate, tin octadecylmercaptoacetate, magnesium decylmercaptoacetate, magnesium dodecylmercaptoacetate, magnesium tetradecylmercaptoacetate, magnesium hexadecylmercaptoacetate, magnesium octadecylmercaptoacetate, zinc decylmercaptoacetate, zinc dodecylmercaptoacetate, zinc tetradecylmercaptoacetate, zinc hexadecylmercaptoacetate, zinc octadecylmercaptoacetate, copper decylmercaptoacetate, copper dodecylmercaptoacetate, copper tetradecylmercaptoacetate, copper hexadecylmercaptoacetate, and copper octadecylmercaptoacetate.

Not only the previously mentioned compounds, but also other electron-accepting compounds are usable as the color developers in the present invention. In addition, those color developers may be used alone or in combination.

It is preferable that the amount of color developer be in the range of 0.5 to 20 parts by weight, more preferably in the range of 2 to 10 parts by weight, to one part by weight of coloring agent.

The thermosensitive recording layer may comprise an organic silver salt and a reducing agent in combination.

Specific examples of the organic silver salts include silver salts of long-chain aliphatic carboxylic acid, such as silver laurate, silver myristate, silver palmitate, silver stearate, silver arachate, and silver behenate; silver salts of imino-group-containing organic compound, such as benzotriazole silver salt, benzimidazole silver salt, carbazole silver salt, and phthalazinone silver salt; silver salts of sulfur-containing compound, such as s-alkylthioglycolate; silver salts of aromatic carboxylic acid, such as silver benzoate and silver phthalate; silver salts of sulfonic acid, such as silver ethanesulfonate; silver salts of sulfinic acid, such as silver o-toluenesulfinate; silver salts of phosphonic acid such as silver phenylphosphonate; silver barbiturate; silver saccharinate; silver salt of salicylaldoxime; and mixture thereof.

Specific examples of the reducing agent for use in the present invention are monophenol, bisphenol, trisphenol, tetrakisphenol, mononaphthol, bisnaphthol, dihydroxynaphthalene, polyhydroxynaphthalene, dihydroxybenzene, polyhydroxybenzne, hydroxymonoether, ascorbic acid, 3-pyrazolidone, pyrazoline, pyrazolone, reducing sugar, phenylenediamine, hydroxylamine, reductone, hydroxyamine, hydrazide, amideoxime, and N-hydroxyurea When the thermosensitive recording layer comprises the combination of an organic low-molecular weight material and a matrix resin, there is employed any organic low-molecular material that can be dispersed in the form of particles in a resin and is capable of changing between a polycrystalline state and a single crystalline state depending on the temperature thereof. In general, an organic low-molecular weight compound having a melting point of about 30 to 200° C., preferably about 50 to 150° C. is employed. Examples of such an organic low-molecular weight compound are disclosed in Japanese Laid-Open Patent Application 7-179062.

Specific examples of the organic low-molecular weight compounds are alkanol, alkanediol, halogenated alkanol, halogenated alkanediol, alkylamine, alkane, alkene, alkyne, halogenated alkane, halogenated alkene, halogenated alkyne, cycloalkane, cycloalkene, cycloalkyne, saturated or unsaturated monocarboxylic acid and esters thereof, and saturated or unsaturated dicarboxylic acid, and esters thereof. Of these compounds, aliphatic esters such as octadecyl palmitate, docosyl palmitate, heptyl stearate, octyl stearate, octadecyl stearate, docosyl stearate, octadecyl behenate, and docosyl behenate are preferably employed. These compounds may be employed alone or in combination.

The light resistant additives for use in the present invention will now be explained in detail.

Examples of the benzotriazole ultraviolet light absorber include 2-(5-methyl-2-hydroxyphenyl)benzotriazole, 2-(3,5-di-t-butyl-2-hydroxyphenyl)-5-chlorobenzotriazole, 2-(3-t-butyl-5-methyl-2-hydroxyphenyl)-5-chlorobenzotriazole, 2-(3,5-di-t-amyl-2-hydroxyphenyl)benzotriazole, 2-(3,5-di-t-butyl-2-hydroxyphenyl)benzotriazole, 2-(5-t-butyl-2-hydroxyphenyl)benzotriazole, and 2-(5-t-octyl-2-hydroxyphenyl)benzotriazole.

Examples of the benzophenone ultraviolet light absorber are 2,4-dihydroxybenzophenone, 2-hydroxy-4-methoxybenzophenone, 2-hydroxy-4-n-octoxybenzophenone, 2,2'-dihydroxy-4-methoxybenzophenone, 2,2',4,4'-tetrahydroxybenzophenone, and 2,2'-dihydroxy-4,4'-dimethoxybenzophenone.

Examples of the hindered amine light stabilizer include bis(1,2,2,6,6-pentamethyl-4-piperidyl)sebacate, bis(2,2,6,6-tetramethyl-4-piperidyl)sebacate, bis(1,2,2,6,6-pentamethyl-4-piperidyl) 2-(3,5-di-t-butyl-4-hydroxybenzyl)-2-n-butylmalonate, and 4-benzoyloxy-2,2,6,6-tetramethylpiperidine. The hindered amine light stabilizer is not limited to the above-mentioned compounds. Any compounds having a piperidyl skeleton are usable.

Examples of the hindered phenolic antioxidant include 2-methylphenol, 2,6-dimethylphenol, 2,4,6-trimethylphenol, 2,6-dimethyl-4-octylphenol, 2-t-butylphenol, 2,6-di-t-butylphenol, 2,4,6-tri-t-butylphenol, 2,6-di-t-butyl-4-octylphenol, triethyleneglycolbis[3-(3-t-butyl-5-methyl-4-hydroxyphenyl)propionate], 1,6-hexanediolbis[3-(3,5-di-t-butyl-4-hydroxyphenyl) propionate], 2,4-bis(n-octylthio)-6-(4-hydroxy-3,5-di-t-butylanilino)-1,3,5-triadine, pentaerythrityl tetrakis[3-(3,5-d-t-butyl-4-hydroxyphenyl)propionate], 2,2-thiodiethylenebis[3-(3,5-di-t-butyl-4-hydroxyphenyl) propionate, octadecyl-3-(3,5-di-t-butyl-4-hydroxyphenyl) propionate, N,N'-hexamethylenebis(3,5-di-t-butyl-4-hydroxyhydrocinnamide), 3,5-di-t-butyl-4-hydroxybenzylphosphonate diethyl ester, 1,3,5-trimethyl-2,4,6-tris(3,5-di-t-butyl-4-hydroxybenzyl)benzene, tris(3,5-di-t-butyl-4-hydroxybenzyl)isocyanurate, 2,4-bis[(octylthio)methyl]-o-cresol, and N,N'-bis[3-(3,5-di-t-butyl-4-hydroxyphenyl)propionyl]hydrazine.

A variety of conventional fluorescent whitening agents can also be used in the present invention. For example, pyrazoline derivatives, coumarin derivatives, and stilbene derivatives may be used alone or in combination.

In addition to the above, tertiary amine derivatives such as triphenylamine and N-alkyldiphenylamine, dithiodimorpholine, zinc dithiocarbamate, and triazine are also usable as the light resistant additives.

Alternatively, a polymer having a pendant which comprises a skeleton of any of the above-mentioned light resistant additives may be used as a binder agent, or such a polymer may be used together with other resins.

As the ultraviolet light screening agent, there can be employed various kinds of metallic oxide powders, for example, selenium oxide powder, titanium oxide powder, and zinc oxide powder. It is preferable that the above-mentioned powders be as fine as possible, to be more specific, have an average particle size of 3 μm or less, more preferably 0.7 μm or less.

The leuco dye, color developer, metallic salt of organic acid, reducing agent, organic low-molecular weight compound, binder resin, and light resistant additive are not limited to the respective examples as mentioned above.

The thermosensitive recording layer may further comprise a filler, a pigment, a surfactant, and a thermofusible material when necessary.

To provide the thermosensitive recording layer, for instance, a coloring agent and a color developer are uniformly dispersed or dissolved in an organic solvent, optionally together with a binder resin, to prepare a coating liquid for the thermosensitive recording layer. The thus prepared coating liquid is coated on the transparent support and dried, whereby a thermosensitive recording layer is provided on the support. In this case, the coating method is not particularly limited. When a dispersion is used as the coating liquid for the thermosensitive recording layer, it is preferable that the particle size of the components dispersed in the dispersion be controlled to 1.0 μm or less, more preferably 0.5 μm or less. This is because the particle size of the dispersed components in the dispersion has a serious effect on the surface roughness of the protective layer provided thereon, and consequently dot reproduction performance of the obtained image is greatly influenced.

The thickness of the thermosensitive recording layer is determined depending upon the composition of the recording layer and the application of the obtained transparent thermosensitive recording material. It is preferable that the thickness of the recording layer be in the range of about 1 to 50 μm, more preferably in the range of about 3 to 20 μm.

The coating liquid for the thermosensitive recording layer may further comprise a surfactant and other additives when necessary for the purpose of improving the coating characteristics and recording properties.

In the present invention, the transparent thermosensitive recording material may further comprise an intermediate layer which is provided between the transparent support and the thermosensitive recording layer in order to increase the adhesion of the thermosensitive recording layer to the transparent support. The intermediate layer may comprise a pigment, binder agent, and a thermofusible material.

The thermosensitive recording material of the present invention may further comprise a protective layer which is overlaid on the thermosensitive recording layer in order to improve the chemical resistance, water resistance, rub resistance, light resistance, and head matching properties with the employed thermal head.

The protective layer consisting of a resin is ideal from the viewpoint of transparency of the thermosensitive recording material. However, the surface smoothness of the protective layer made of a resin is too high to cause the sticking problem. Further, due to such a high surface smoothness of the protective layer, there is a risk of dust on the recording material being dragged by the thermal head. This phenomenon is hereinafter referred to as dragging problem. In particular, when a plastic film is used as the transparent support, the head matching properties tend to lower and the dragging problem becomes serious. Defective images and abnormal images thus formed by the sticking problem and dragging problem are fatal to the image formation for medical purposes.

As means for preventing such a sticking problem and dragging problem, a filler is conventionally added to the protective layer. In the transparent thermosensitive recording material, however, there is a risk of the decrease in transparency when the filler is contained in the protective layer in such a conventional manner as employed in the reflection type thermosensitive recording material. In the present invention, it is recommended that a filler in the form of minute particles be contained in the protective layer for slightly but entirely roughening the surface of the protective layer. Alternatively, the surface of the protective layer may be partially roughened by the addition of a small amount of filler in the form of relatively large particles to the protective layer. Further, the above-mentioned manners may be appropriately combined when the protective layer is provided on the thermosensitive recording layer.

It is preferable that the coefficient of friction of the protective layer be in the range of 0.07 to 0.14 when consideration is given to both aspects, that is, the increase in lubricating properties to improve the head matching properties, and the decrease in lubricating properties to prevent the dragging problem of dust.

Examples of the filler for use in the protective layer include inorganic fillers such as phosphate fiber, potassium titanate, needle-like magnesium hydroxide, whisker, talc, mica, glass flake, calcium carbonate, calcium carbonate in the form of plates, aluminum hydroxide, aluminum hydroxide in the form of plates, silica, clay, kaolin, calcined clay, and hydrotalcite; and organic fillers such as crosslinked polystyrene resin powder, urea—formalin copolymer powder, silicone resin powder, crosslinked poly(methyl methacrylate) resin powder, guanamine—formaldehyde copolymer powder, and melamine—formaldehyde copolymer powder. In the present invention, the organic fillers are preferred because abrasion of a thermal head can be avoided. For example, the commercially available melamine—formaldehyde copolymer powder (Trademark "EPOSTAR S" made by Nippon Shokubai Co., Ltd.) is preferably employed as the filler in the form of fine particles; and the guanamine—formaldehyde copolymer powder and the silicone resin powder are preferably employed as the filler in the form of relatively large particles.

As the resin for use in the protective layer, a water-soluble resin, an aqueous emulsion, a hydrophobic resin, an ultraviolet curing resin, and an electron-beam curing resin can be used alone, or in combination when necessary. From the viewpoint of transparency, it is preferable to determine the resin material for use in the thermosensitive recording layer or the protective layer so that the ratio of the refractive index of each resin material of the recording layer or the protective layer to that of the transparent support may be in the range of 0.8 to 1.2.

Specific examples of the resins for use in the protective layer are polyacrylate resin, polymethacrylate resin, polyurethane resin, polyester resin, polyvinyl acetate resin, styrene acrylate resin, polyolefin resin, polystyrene resin, polyvinyl chloride resin, polyether resin, polyamide resin, polycarbonate resin, polyethylene resin, polypropylene resin, and polyacrylamide resin.

It is possible to employ the conventional crosslinking agents such as isocyanate compounds and epoxy compounds together with the above-mentioned resins.

Specific examples of the isocyanate compounds having two or more isocyanate groups in a molecule thereof are toluylenediisocyanate, dimers thereof, diphenylmethane diisocyanate, polymethylene polyphenylisocyanate, hexamethylene diisocyanate, polyisocyanate, and derivatives of those compounds.

Specific examples of the epoxy compounds are ethylene glycol glycidyl ether, butyl glycidyl ether, polyethylene glycol diglycidyl ether, and epoxy acrylate.

Furthermore, the protective layer may further comprise a variety of waxes and oils to improve the head matching properties. Specific examples of the waxes are stearamide, palmitamide, oleamide, lauramide, ethylenebisstearamide, methylenebisstearamide, methylolstearamide, paraffin wax, polyethylene, carnauba wax, paraffin oxide, and zinc stearate As the oils for use in the protective layer, there can be employed general-purpose silicone oils.

In addition, the coefficient of friction of the protective layer can be adjusted by employing a binder resin comprising a silicone-modified resin, and controlling the ratio of the resin to the filler.

The coating method for the formation of the protective layer is not particularly limited. The protective layer can be provided by any conventional coating method. It is preferable that the thickness of the protective layer be in the range of 0.1 to 20 $\mu$m, more preferably in the range of 0.5 to 10 $\mu$m. When the thickness of the protective layer is within the above-mentioned range, the functions of the protective layer to improve the preservation stability of the recording material and the head matching properties can be sufficiently attained. At the same time, the decrease in thermal sensitivity of the recording material can be effectively prevented, and the manufacturing cost is adequate.

The transparent thermosensitive recording material of the present invention is a plastic film. In addition, the recording material is prepared in the form of a sheet, or a sheet-shaped thermosensitive recording material is rolled while stored in a paper feed section of the recording apparatus. Therefore, there is a risk of dust electrostatically adhering to the surface of the recording material when the recording material is transported in the recording apparatus.

To impart the antistatic properties to the thermosensitive recording material, a backcoat layer may be provided on the support, opposite to the thermosensitive recording layer with respect to the support. Any conventional electronic conduction type materials and ion conduction type materials may be added to the backcoat layer as long as the backcoat layer can appear transparent. It is preferable that the surface resistivity of the backcoat layer be $1\times10^{10}\Omega$ or less in light of the function to prevent the dust from electrostatically adhering to the recording material.

Further, the backcoat layer for use in the present invention may be provided with the functions to reduce the curling of the recording material, to control the stiffness of the recording material, to absorb the ultraviolet light. In addition, the backcoat layer may further comprise a matting agent so as to have a silver salt film appearance. To obtain such a silver salt film appearance, any conventional materials can be employed for the backcoat layer as long as the transparency of the transparent thermosensitive recording material can be ensured.

When the sheet-shaped transparent thermosensitive recording material of the present invention is prepared in the form of a roll, it is preferable that the thermosensitive recording material bear a mark thereon indicating an end position of the roll for user's convenience. To indicate the end position, a different kind of film which can be apparently recognized may be attached to the recording material at the end position thereof, the end portion of the recording material in the form of a roll may be entirely or partially colored, or a mark may be entirely or partially printed on the end portion with ink. The thermosensitive recording material is designed for direct thermosensitive recording system, so that the easiest way is to induce the color development at the end portion of the recording material.

When the thermosensitive recording material in the form of a roll is set in the recording apparatus, unwinding of the roll can be effectively avoided by controlling the Gurley stiffness of the recording material as previously explained. Further, by attaching at least one stopper to each of both ends of the roll as illustrated in a single FIGURE, the outer diameter of the roll can be surely prevented from expanding over a predetermined diameter permissible to be fit in the recording apparatus even if the roll becomes unwound. Thus, the handling properties in the recording apparatus can be further improved.

When the curling problem of the rolled thermosensitive recording sheet is taken into consideration, it is preferable that the inner diameter of the rolled thermosensitive recording sheet be 35 mm or more. By setting the inner diameter of the roll at 35 mm or more, even a center portion of the roll can be prevented from becoming curled. As previously mentioned, when the curling degree of the thermosensitive recording material is considerable, the image-bearing recording material cannot be easily set to a film viewer. It is preferable that the curling degree of the four sides of a sheet be controlled to 0±30 mm on the average when the thermosensitive recording material is cut into a sheet of A4 size.

The method of recording images on the thermosensitive recording material is not particularly limited, but determined depending upon the application of the recording material. For example, a thermal pen, thermal head, and laser beams are employed. The transparent thermosensitive recording material of the present invention is suitable for the formation of images with high precision and high resolution. In view of such performance of the recording material, the thermal head is the most preferable recording means in the present invention. Further, the thermal head can be considered to be advantageous in terms of the total cost of the recording apparatus, the output speed, and the reduction in the size of the apparatus.

Other features of this invention will become apparent in the course of the following description of exemplary embodiments, which are given for illustration of the invention and are not intended to be limiting thereof.

EXAMPLE 1

[Formation of Thermosensitive Recording Layer]

The following components were pulverized and dispersed in a ball mill, so that a liquid (A), namely, a color developer dispersion No. 1 was prepared. The particle diameter of the color developer was controlled to 0.5 $\mu$m. The particle diameter was measured using a commercially available laser scattering particle size distribution analyzer "LA-700" (Trademark), made by HORIBA, Ltd.

[Liquid (A)]

| | Parts by Weight |
|---|---|
| Methyl ethyl ketone | 25 |
| Toluene | 25 |
| Octadecylphosphonic acid | 20 |

-continued

[Liquid (A)]

| | Parts by Weight |
|---|---|
| 10% methyl ethyl ketone solution of polyvinyl butyral | 30 |

The following components were sufficiently stirred, so that a liquid (B), namely, a thermosensitive recording layer coating liquid No. 1 was prepared.

[Liquid (B)]

| | Parts by Weight |
|---|---|
| Liquid (A) | 90 |
| 2-(3-t-butyl-5-methyl-2-hydroxy-phenyl)-5-chlorobenzotriazole | 7 |
| Pentaerythrityl tetrakis[3-(3,5-di-t-butyl-4-hydroxyphenyl)propionate] | 7 |
| Phenyl-1-naphthylamine | 3 |
| 2-anilino-3-methyl-6-diethylamino-fluoran | 20 |
| 10% methyl ethyl ketone solution of polyvinyl acetoacetal | 200 |
| Methyl ethyl ketone | 28 |

The above prepared thermosensitive recording layer coating liquid No. 1 was coated on a transparent polyester film with a thickness of 100 μm by a wire bar, and dried, whereby a thermosensitive recording layer with a thickness of 10 μm was provided on the transparent polyester film.

[Formation of Protective Layer]

The following components were pulverized and dispersed in a ball mill until the volume mean diameter of silica particles reached 0.3 μm, so that a liquid (C), namely, a filler dispersion was prepared.

[Liquid (C)]

| | Parts by Weight |
|---|---|
| Silica particles | 15 |
| 10% methyl ethyl ketone solution of polyvinyl acetoacetal | 15 |
| Methyl ethyl ketone | 70 |

The following components were sufficiently stirred, so that a coating liquid (D), namely, a protective layer coating liquid No. 1 was prepared.

[Liquid (D)]

| | Parts by Weight |
|---|---|
| Liquid (C) | 10 |
| Silicone-modified polyvinyl butyral (solid content: 12.5 wt. %) | 6 |
| Methyl ethyl ketone | 12 |

The above prepared protective layer coating liquid No. 1 was coated on the thermosensitive recording layer by a wire bar, and dried, whereby a protective layer with a thickness of 3 μm was provided on the thermosensitive recording layer.

Thus, a transparent thermosensitive recording material No. 1 according to the present invention was obtained.

EXAMPLE 2

The procedure for preparation of the transparent thermosensitive recording material No. 1 in Example 1 was repeated except that the amounts of 2-(3-t-butyl-5-methyl-2-hydroxyphenyl)-5-chlorobenzotriazole and methyl ethyl ketone for use in the formulation for the liquid (B) in Example 1 were respectively changed to 4 parts by weight and 31 parts by weight.

Thus, a transparent thermosensitive recording material No. 2 according to the present invention was obtained.

EXAMPLE 3

[Formation of Thermosensitive Recording Layer]

The following components were pulverized and dispersed using a sand mill until the particle size of dispersed particles reached 0.3 μm, so that a coating liquid (E), namely, a leuco dye dispersion was prepared.

[Liquid (E)]

| | Parts by Weight |
|---|---|
| 2-anilino-3-methyl-6-diethyl-aminofluoran | 20 |
| p-benzylbiphenyl | 10 |
| 10% aqueous solution of polyvinyl alcohol | 30 |
| Water | 60 |

The following components were pulverized and dispersed using a sand mill until the particle size of dispersed particles reached 0.3 μm, so that a coating liquid (F), namely, a color developer dispersion No. 2 was prepared.

[Liquid (F)]

| | Parts by Weight |
|---|---|
| 4-hydroxy-4'-isopropoxy-diphenylsulfone | 20 |
| 10% aqueous solution of polyvinyl alcohol | 20 |
| Water | 40 |

The following components were pulverized and dispersed using a sand mill until the particle size of dispersed particles reached 0.3 μm, so that a coating liquid (G), namely, an ultraviolet light absorber dispersion was prepared.

[Liquid (G)]

| | Parts by Weight |
|---|---|
| 2-(3-t-butyl-5-methyl-2-hydroxy-phenyl)-5-chlorobenzotriazole | 15 |
| 4,4'-butylidenebis(3-methyl-6-t-butylphenol) | 15 |
| 10% aqueous solution of polyvinyl alcohol | 20 |
| Water | 50 |

The following components were mixed and stirred, so that a liquid (H), namely; a thermosensitive recording layer coating liquid No. 2 was prepared.

[Liquid (H)]

| | Parts by Weight |
|---|---|
| Liquid (E) | 120 |
| Liquid (F) | 100 |
| Liquid (G) | 25 |
| 10% aqueous solution of polyvinyl alcohol | 60 |
| Water | 70 |

The above prepared thermosensitive recording layer coating liquid No. 2 was coated on a transparent polyester film with a thickness of 100 μm by a wire bar, and dried, whereby a thermosensitive recording layer with a thickness of 10 μm was provided on the transparent polyester film.

[Formation of Protective Layer]

The following components were sufficiently mixed and stirred, so than a coating liquid (I), namely, a protective layer coating liquid No. 2 was prepared.

[Liquid (I)]

| | Parts by Weight |
|---|---|
| Water | 26 |
| Aqueous dispersion of zinc stearate (solid content: 30 wt. %) | 1 |
| Silica | 3 |
| 10% aqueous solution of polyvinyl alcohol | 70 |

The above prepared protective layer coating liquid No. 2 was coated on the thermosensitive recording layer by a wire bar, and dried, whereby a protective layer with a thickness of 3 μm was provided on the thermosensitive recording layer.

Thus, a transparent thermosensitive recording material No. 3 according to the present invention was obtained.

EXAMPLE 4

[Formation of Thermosensitive Recording Layer]

The following components were sufficiently mixed and stirred, so that a liquid (J), namely, a thermosensitive recording layer coating liquid No. 3 was prepared.

[Liquid (J)]

| | Parts by Weight |
|---|---|
| Behenic acid | 8 |
| Stearyl stearate | 2 |
| (2-ethylhexyl)phthalate | 3 |
| 2-(3-t-butyl-5-methyl-2-hydroxy-phenyl)-5-chlorobenzotriazole | 1 |
| Vinyl chloride - vinyl acetate copolymer | 27 |
| Tetrahydrofuran | 200 |

The above prepared thermosensitive recording layer coating liquid No. 3 was coated on a transparent polyester film with a thickness of 100 μm by a wire bar, and dried, whereby a thermosensitive recording layer with a thickness of 10 μm was provided on the transparent polyester film.

[Formation of Protective Layer]

The following components were sufficiently mixed and stirred, so that a coating liquid (K), namely, a protective layer coating liquid No. 3 was prepared.

[Liquid (K)]

| | Parts by Weight |
|---|---|
| Urethane acrylate | 10 |
| Toluene | 10 |

The above prepared protective layer coating liquid No. 3 was coated on the thermosensitive recording layer by a wire bar, and dried, whereby a protective layer with a thickness of 3 μm was provided on the thermosensitive recording layer.

Thus, a transparent thermosensitive recording material No. 4 according to the present invention was obtained.

An image formed on the transparent thermosensitive recording material No. 4 was erased therefrom by heating the recording material to 65° C.

EXAMPLE 5

The procedure for preparation of the transparent thermosensitive recording material No. 1 in Example 1 was repeated except that the amounts of 2-(3-t-butyl-5-methyl-2-hydroxyphenyl)-5-chlorobenzotriazole and methyl ethyl ketone for use in the formulation for the liquid (B) in Example 1 were respectively changed to 10 parts by weight and 25 parts by weight, and that the particle size of the dispersed color developer particles was controlled to 0.3 μm.

Thus, a transparent thermosensitive recording material No. 5 according to the present invention was obtained.

EXAMPLE 6

[Formation of Backcoat Layer]

The following components were mixed, so that a liquid (L), namely, a backcoat layer coating liquid was prepared.

[Liquid (L)]

| | Parts by Weight |
|---|---|
| Polyester resin | 10 |
| 2-(3-t-butyl-5-methyl-2-hydroxy-phenyl)-5-chlorobenzotriazole | 1 |
| Methyl ethyl ketone | 54 |
| Cyclohexanone | 35 |

The above prepared backcoat layer coating liquid was coated on one surface of a transparent polyester film with a thickness of 100 μm by a wire bar, and dried, whereby a backcoat layer with a thickness of 4 μm was provided on the transparent polyester film.

On the other surface of the transparent polyester film, the thermosensitive recording layer and the protective layer were successively provided in the same manner as in Example 2.

Thus, a transparent thermosensitive recording material No. 6 according to the present invention was obtained.

EXAMPLE 7

The procedure for preparation of the transparent thermosensitive recording material No. 5 in Example 5 was repeated except that the transparent polyester film serving as a support in Example 5 was blue-colored.

Thus, a transparent thermosensitive recording material No. 7 according to the present invention was obtained.

Comparative Example 1

The procedure for preparation of the transparent thermosensitive recording material No. 1 in Example 1 was repeated except that the amounts of 2-(3-t-butyl-5-methyl-2-hydroxyphenyl)-5-chlorobenzotriazole and methyl ethyl ketone for use it the formulation for the liquid (B) in Example 1 were respectively changed to 12 parts by weight and 23 parts by weight, and that the particle size of the dispersed color developer particles was controlled to 1.2 μm.

Thus, a comparative transparent thermosensitive recording material No. 1 was obtained.

Comparative Example 2

The procedure for preparation of the transparent thermosensitive recording material No. 1 in Example 1 was repeated except that the amounts of 2-(3-t-butyl-5-methyl-2-hydroxyphenyl)-5-chlorobenzotriazole and methyl ethyl ketone for use in the formulation for the liquid (B) in Example 1 were respectively changed to 7 parts by weight and 23 parts by weight, and that the particle size of the dispersed color developer particles was controlled to 1.2 μm.

Thus, a comparative transparent thermosensitive recording material No. 2 was obtained.

Comparative Example 3

The procedure for preparation of the transparent thermosensitive recording material No. 1 in Example 1 was repeated except that the amounts of 2-(3-t-butyl-5-methyl-2-hydroxyphenyl)-5-chlorobenzotriazole and methyl ethyl ketone for use in the formulation for the liquid (B) in Example 1 were respectively changed to 12 parts by weight and 23 parts by weight, and that the particle size of the dispersed color developer particles was controlled to 0.3 μm.

Thus, a comparative transparent thermosensitive recording material No. 3 was obtained.

Comparative Example 4

The procedure for preparation of the transparent thermosensitive recording material No. 1 in Example 1 was repeated except that the amounts of 2-(3-t-butyl-5-methyl-2-hydroxyphenyl)-5-chlorobenzotriazole and methyl ethyl ketone for use in the formulation for the liquid (B) in Example 1 were respectively changed to 2 parts by weight and 33 parts by weight, and that the particle size of the dispersed color developer particles was controlled to 0.3 μm.

Thus, a comparative transparent thermosensitive recording material No. 4 was obtained.

Each of the transparent thermosensitive recording materials obtained in Examples 1 to 7 and comparative Examples 1 to 4 was cut into a sample film to evaluate the following properties.

1. Haze

The haze of each sample film was measured using a commercially available haze meter "HGH-2DP" (Trademark), made by Suga Test Instruments Co., Ltd.

2. Light-source Dependence

The same two sample films were made from each recording material. With respect to the light source, a light of a film viewer ("Schaukasten") was used as the diffused light, and a fluorescent lighting was used as the specular light. The sample film was arranged between the observer and the light source in a straight line, 60 centimeters apart from the observer, and 2 meters apart from the light source. The light-source dependence of the thermosensitive recording material was judged from the difference in tint of sample films depending on the light source, and evaluated on the following scale.

◎: The difference in tint was not at all perceived by visual observation.

○: The difference in tint was scarcely perceived by visual observation.

X: The difference in tint depending on the light source was perceived by visual observation.

3. Light Resistance

The same two sample films were made from each recording material. One of the sample films was stored under cool and dark conditions. The other film was stored with the back side of the recording material, opposite to the thermosensitive recording layer side, being irradiated with a fluorescent lighting of 7,000 lux for 100 hours. After that, both sample films were set to the film viewer with diffused light.

The light resistance of the thermosensitive recording material was evaluated on the following scale.

◎: There was no change in tint of the thermosensitive recording material after exposure to the fluorescent lighting.

○: The change in tint of the thermosensitive recording material was scarcely observed after exposure to the fluorescent lighting.

X: There was some change in tint of the thermosensitive recording material after exposure to the fluorescent lighting.

4. Image Recognition Performance

Using a commercially available video printer "UP-930" (Trademark), made by Sony Corporation, a medical image was printed on each transparent thermosensitive recording material. The printed image was observed on the film viewer for medical application, and the recognition performance was evaluated on the following scale.

◎: The image contrast appeared remarkably clear.

○: The image contrast appeared clear.

X: The image contrast appeared unclear.

5. Absorbance

The absorbance of each transparent thermosensitive recording material with respect to the light with a wavelength of 380 nm or 420 nm was measured using a commercially available automatic spectrophotometer "U-3210" (Trademark), made by Hitachi, Ltd.

The evaluation results are shown in TABLE 1.

TABLE 1

| | Haze (%) | Light-source Dependence | Light Resistance | Image Recognition | Absorbance (880 nm) | Absorbance (420 nm) |
|---|---|---|---|---|---|---|
| Ex. 1 | 27 | ○ | ○ | ○ | 0.9 | 0.7 |
| Ex. 2 | 25 | ○ | ○ | ○ | 0.5 | 0.6 |
| Ex. 3 | 38 | ○ | ○ | ○ | 1.0 | 0.7 |
| Ex. 4 | 22 | ○ | ○ | ○ | 0.7 | 0.5 |
| Ex. 5 | 15 | ◎ | ◎ | ◎ | 0.9 | 0.4 |
| Ex. 6 | 27 | ○ | ○ | ○ | 0.9 | 0.7 |
| Ex. 7 | 21 | ◎ | ◎ | ◎ | 0.9 | 0.4 |
| Comp. Ex. 1 | 47 | X | ◎ | X | 1.5> | 0.9> |
| Comp. Ex. 2 | 45 | X | ○ | X | 1.2 | 0.9> |
| Comp. Ex. 3 | 18 | X | ◎ | ○ | 1.3> | 0.6 |
| Comp. Ex. 4 | 14 | ◎ | X | ○ | 0.4< | 0.4 |

As previously explained, the transparent thermosensitive recording material is free of the light-source dependence, and is provided with excellent light resistance and image recognition performance.

Japanese Patent Application No. 10-309519 filed Oct. 16, 1998 is hereby incorporated by reference.

What is claimed is:

1. A transparent thermosensitive recording material comprising a transparent support and a thermosensitive recording layer formed thereon, with a non-image area of said transparent thermosensitive recording material exhibiting an absorbance in a range from 0.5 to 1.2 when irradiated with light with a wavelength of 380 nm, and an absorbance of 0.7 or less when irradiated with light with a wavelength of 420 nm.

2. The thermosensitive recording material as claimed in claim 1, exhibiting a haze of 40% or less.

3. The thermosensitive recording material as claimed in claim 1, wherein said thermosensitive recording layer comprises a colorless or light-colored leuco dye, a color developer capable of inducing coloring formation in said leuco dye, and a binder resin.

4. The thermosensitive recording material as claimed in claim 3, wherein said color developer comprises an organic phosphonic acid compound.

5. The thermosensitive recording material as claimed in claim 1, wherein said transparent thermosensitive recording material is blue-colored.

6. The thermosensitive recording material as claimed in claim 1, further comprising a protective layer which is provided on said thermosensitive recording layer.

7. The thermosensitive recording material as claimed in claim 6, wherein said protective layer has a coefficient of friction in a range of 0.07 to 0.14.

8. The thermosensitive recording material as claimed in claim 1, further comprising a backcoat layer which is provided on said support, opposite to said thermosensitive recording layer with respect to said support.

9. The thermosensitive recording material as claimed in claim 8, wherein said backcoat layer comprises an ultraviolet light absorber.

10. The thermosensitive recording material as claimed in claim 8, wherein said backcoat layer has a surface resistivity of $1\times10^{10}\Omega$ or less.

11. The thermosensitive recording material as claimed in claim 1, further comprising a protective layer which is provided on said thermosensitive recording layer, and a backcoat layer which is provided on said support, opposite to said thermosensitive recording layer with respect to said support.

12. The thermosensitive recording material as claimed in claim 11, wherein said protective layer has a coefficient of friction in a range of 0.07 to 0.14.

13. The thermosensitive recording material as claimed in claim 11, wherein said backcoat layer comprises an ultraviolet light absorber.

14. The thermosensitive recording material as claimed in claim 11, wherein said backcoat layer has a surface resistivity of $1\times10^{10}\Omega$ or less.

15. The thermosensitive recording material as claimed in claim 1, wherein said thermosensitive recording layer is a reversible thermosensitive recording layer whose transparency, density or color reversibly changes by the application of heat thereto.

16. The thermosensitive recording material as claimed in claim 1, wherein said thermosensitive recording layer is formed by coating on said transparent support and said thermosensitive recording material comprises a sheet-shaped thermosensitive recording material with a Gurley stiffness of 500 mgf to 2,500 mgf when measured in the coating direction of said thermosensitive recording layer.

17. The thermosensitive recording material as claimed in claim 16, wherein said support is a polyethylene terephthalate film with a thickness of 150 to 230 $\mu$m.

18. The thermosensitive recording material as claimed in claim 16, wherein said sheet-shaped thermosensitive recording material is hermetically sealed in a bag with light shielding properties and/or moisture-proof properties.

19. The thermosensitive recording material as claimed in claim 1, wherein said thermosensitive recording material comprises a roll of a sheet-shaped thermosensitive recording material with a Gurley stiffness of 190 mgf to 250 mgf when measured in the rolling direction of said thermosensitive recording material.

20. The thermosensitive recording material as claimed in claim 19, wherein said support is a polyethylene terephthalate film with a thickness of 90 to 110 $\mu$m.

21. The thermosensitive recording material as claimed in claim 19, wherein said roll has an inner diameter of 35 mm or more.

22. The thermosensitive recording material as claimed in claim 19, wherein said roll comprises at least one stopper which is attached to each of both ends of said roll.

23. The thermosensitive recording material as claimed in claim 19, wherein said thermosensitive recording material bears a mark thereon indicating art end position of said roll.

24. The thermosensitive recording material as claimed in claim 19, wherein said roll is hermetically sealed in a bag with light shielding properties and/or moisture-proof properties.

* * * * *